US006202988B1

(12) United States Patent
Abe et al.

(10) Patent No.: US 6,202,988 B1
(45) Date of Patent: Mar. 20, 2001

(54) DIAPHRAGM-TYPE CARBURETOR

(75) Inventors: Hitoshi Abe; Hirohisa Ishikawa; Naoyuki Kamiya, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/361,175

(22) Filed: Jul. 27, 1999

(30) Foreign Application Priority Data

Jul. 28, 1998 (JP) ..... 10-212209

(51) Int. Cl.[7] ..... F02M 17/04

(52) U.S. Cl. ..... 261/34.1; 261/35; 261/69.2; 261/DIG. 68; 261/DIG. 83

(58) Field of Search ..... 261/34.1, 35, 37, 261/71, 64.1, 54, 69.1, 69.2, DIG. 23, DIG. 24, DIG. 38, DIG. 39, DIG. 68, DIG. 83, DIG. 84, DIG. 8

(56) References Cited

U.S. PATENT DOCUMENTS 3,765,657 * 10/1973 Du Bois ..... 261/DIG. 68
3,825,237 * 7/1974 Aoyama et al. ..... 261/69.2 X
4,003,968 * 1/1977 Rickert ..... 261/DIG. 68
4,271,093 * 6/1981 Kobayashi ..... 261/34.1
5,441,673 * 8/1995 Gerhardy ..... 261/34.1
5,599,484 * 2/1997 Tobinai ..... 261/DIG. 8
5,676,887 * 10/1997 Soeda et al. ..... 261/35
5,681,508 * 10/1997 Gerhardy ..... 261/DIG. 68

FOREIGN PATENT DOCUMENTS 1-151758 6/1989 (JP) .

* cited by examiner

*Primary Examiner*—Richard L. Chiesa
(74) *Attorney, Agent, or Firm*—Arent Fox Kintner Plotkin & Kahn

(57) ABSTRACT

A diaphragm-type carburetor includes a fuel well communicating with a lower end of a fuel nozzle, a constant-pressure fuel chamber communicating with the fuel well through an outlet bore, and a fuel pump incorporated in fuel passages defined between an inlet bore of the constant-pressure fuel chamber and a fuel tank. A fuel introduction control valve controls the introduction of fuel into the constant-pressure fuel chamber. The fuel introduction control valve includes a valve seat member which communicates at its lower end with the fuel well through a bypass passage extending above the constant-pressure fuel chamber. Thus, when fuel vapor is introduced into the constant-pressure fuel chamber, it immediately passes towards the fuel nozzle, whereby the extreme reduction in air-fuel ratio of a fuel-air mixture can be avoided.

1 Claim, 2 Drawing Sheets

DIAPHRAGM-TYPE CARBURETOR

BACKGROUND OF THE INVENTION

1. Field of the Invention

The present invention relates to a diaphragm-type carburetor, and in particular, to an improvement in a diaphragm-type carburetor including a constant-pressure fuel chamber having an outlet bore communicating with a lower end of a fuel nozzle through a fuel jet and a check valve, a fuel pump incorporated in a fuel passage which communicates between an inlet bore in the constant-pressure fuel chamber and a fuel tank for providing fuel for the constant-pressure fuel chamber in response to a pulsation pressure in a pulsation pressure generating source, and a fuel introduction control valve for controlling the introduction of the fuel into the constant-pressure fuel chamber by opening or closing the inlet bore in the constant-pressure fuel chamber. The fuel introduction control valve is provided with a cylindrical valve seat member mounted on an upper wall of the constant-pressure fuel chamber and having the inlet bore in its upper end, and a valve member lifted and lowered within the valve seat member to open and close the inlet bore.

2. Description of the Related Art

A diaphragm-type carburetor is already known, as disclosed, for example, in Japanese Patent Application Laid-Open No. 1-151758.

In such a carburetor, fuel delivered to a constant-pressure fuel chamber by operation of a fuel pump is often subjected to pressure pulsation received from the fuel pump, heat or vibration received from an engine or the like to produce fuel vapor. The fuel vapor introduced into the constant-pressure fuel chamber is ejected from a fuel nozzle along with the fuel, because the constant-pressure fuel chamber has no air vent (to enable the operating attitude of the engine in all directions). In the prior art, however, the fuel vapor may stagnate in the constant-pressure chamber depending on the operational attitude of the engine. When the operational attitude of the engine is changed, a large amount of stagnating fuel vapor may be ejected at one time from the fuel nozzle to extremely reduce the fuel-air ratio of the fuel-air mixture, thereby causing misoperation of the engine.

SUMMARY OF THE INVENTION

Accordingly, it is an object of the present invention to provide a diaphragm-type carburetor of the above-described type, wherein when the fuel vapor is introduced into the constant-pressure fuel chamber, the fuel vapor immediately moves towards the fuel nozzle without stagnating in the constant-pressure fuel chamber, whereby the extreme reduction in fuel-air ratio of the fuel-air mixture caused by the fuel vapor can be avoided.

To achieve the above object, according to the present invention, there is provided a diaphragm-type carburetor comprising a constant-pressure fuel chamber having an outlet bore communicating with a lower end of a fuel nozzle through a fuel jet and a check valve. A fuel pump is incorporated in a fuel passage for permitting communication between an inlet in the constant-pressure chamber and a fuel tank for providing fuel to the constant-pressure fuel chamber in response to a pulsation pressure in a pulsation pressure generating source. A fuel introduction control valve controls the introduction of the fuel into the constant-pressure fuel chamber by opening and closing an inlet bore in the constant-pressure fuel chamber. The fuel introduction control valve is provided with a cylindrical valve seat member mounted on an upper wall of the constant-pressure fuel chamber and has the inlet bore at an upper end thereof. A valve member is raised and lowered within the valve seat member for opening and closing the inlet bore, wherein a fuel well is defined between the outlet bore in the constant-pressure fuel chamber and the check valve, and the lower end of the valve seat member is in communication with the fuel well through a bypass passage extending above the constant-pressure fuel chamber.

With the above feature, when the valve member of the fuel introduction control valve opens the inlet bore of the valve seat member, the fuel delivered from the fuel pump is introduced into the constant-pressure fuel chamber through the valve seat member. In this case, if fuel vapor is contained in the fuel, the fuel vapor rises up in the bypass passage connected to the lower end of the valve seat member to enter the fuel well, as soon as it passes through the valve seat member. Thus, the fuel vapor can be ejected promptly from the fuel nozzle along with the other fuel. Therefore, the amount of the fuel vapor ejected from the fuel nozzle is very small and hardly varies the fuel-air ratio of the fuel-air mixture, and hence, the normal operation of the engine can be ensured.

The above and other objects, features and advantages of the invention will become apparent from the following description of the preferred embodiment taken in conjunction with the accompanying drawings.

DESCRIPTION OF THE PREFERRED EMBODIMENTS

Figure 1:
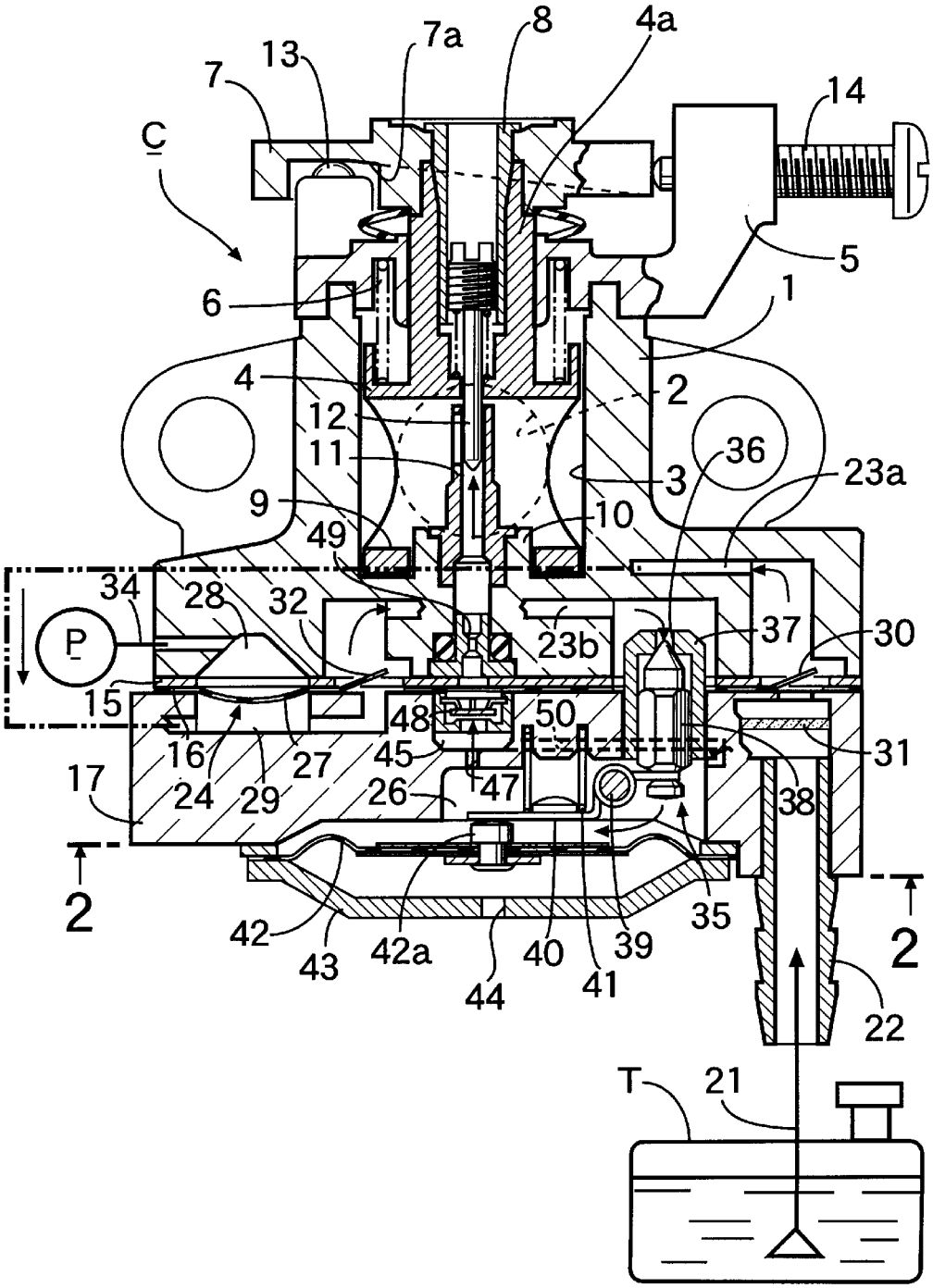
FIG. 1 is a vertical sectional front view of a diaphragm-type carburetor of the present invention.

Referring first to FIG. 1, a diaphragm-type carburetor C is mounted in a hand-held type engine carried on a portable working machine adapted to be used in all-direction attitudes, such as a mowing-off machine. A carburetor body 1 of the carburetor C includes a horizontal intake passage 2 connected to an intake port (not shown) of the engine, and a bottomed cylindrical valve guide bore 3 extending in a vertical direction perpendicular to the intake passage 2. A rotary-type throttle valve 4 is rotatably and slidably received in the valve guide bore 3, and a cap 5 for closing the valve guide bore 3, is secured to the carburetor body 1. A spring 6 is mounted under compression between the throttle valve 4 and the cap 5 for biasing the throttle valve 4 toward a bottom of the valve guide bore 3. The throttle valve 4 has a throttle bore 9 provided so that the area of communication with the intake passage 2 is increased in response to the rotation of the throttle valve 4 in an opening-degree increasing direction.

The throttle valve 4 has a valve stem 4*a* extending through the cap 5, and an operating arm 7 is secured to the valve stem 4*a* by a sleeve 8 fitted in a hollow in the valve stem 4*a*.

A boss 10 is provided in the bottom of the valve guide bore 3 to protrude into the throttle bore 9, and a fuel nozzle 11 is mounted to the boss 10 and rises in the throttle bore 9. A needle valve 12, threadedly mounted in the sleeve 8, is inserted into the fuel nozzle 11.

An annular slant 7*a* is formed on a lower surface of the operating arm 7 and the operating arm 7 is supported by a ball 13 mounted on an upper surface of the cap 5. When the operating arm 7 is rotated in a direction to open the throttle valve 4, it is pushed up by the ball 13, and with this pushing, the throttle valve 4 is displaced upwards along with the needle valve 12 against the biasing force of the spring 6, thereby increasing the opening degree of the fuel nozzle 11.

A stopper bolt 14 is threadedly mounted in the cap 5 for regulation of advancing and retracting movement, and is adapted to abut against the operating arm 7 to define an idle opening degree of the throttle valve 4.

A pressure plate 15, a resilient packing 16 and a bottom plate 17 are coupled to a lower surface of the carburetor body 1 in a sequentially superposed manner. A fuel pipe 21 connected to a fuel tank T is connected to a joint 22 which projects from a lower surface of one side of the bottom plate 17. An upstream fuel passage 23*a* in carburetor body 1 is connected to the joint 22, and a pump chamber 29 in diaphragm-type fuel pump 24 in bottom plate 17. A downstream fuel passage 23*b* is provided in the carburetor body 1 and is connected to the pump chamber 29, and a constant-pressure fuel chamber 26 is provided in the bottom plate 17 and is connected to the downstream fuel passage 23*b*.

The diaphragm-type fuel pump 24 has a diaphragm 27 formed by a portion of packing 16. An operating chamber 28 and the pump chamber 29 faced by upper and lower surfaces of the diaphragm 27, are formed on the carburetor body 1 and the bottom plate 17, respectively. An intake valve 30 utilizing a portion of the packing 16, and a fuel filter 31 located upstream of the intake valve 30, are mounted in the upstream fuel passage 23*a*, and a discharge valve 32 likewise utilizing a portion of the packing 16, is mounted in the downstream fuel passage 23*b*. The operating chamber 28 communicates with a pulsation pressure generating source P, e.g., the inside of a crank chamber or an intake pipe through a conduit 34.

Figure 2:
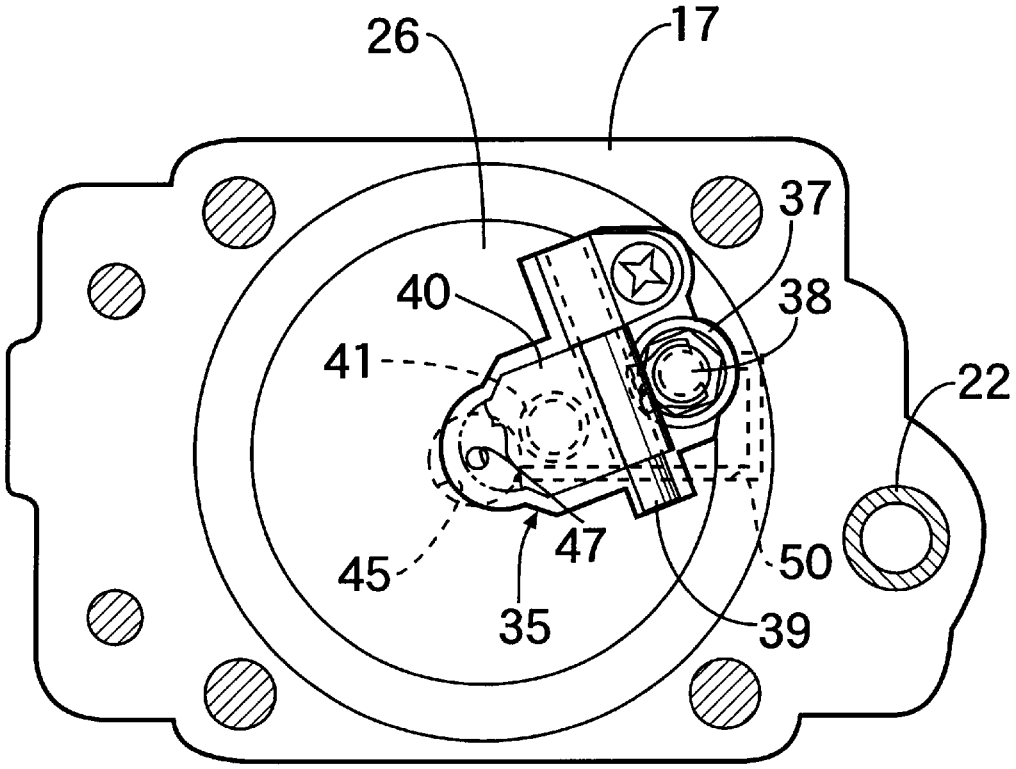
FIG. 2 is a sectional view taken along a line 2—2 in FIG. 1.

As shown in FIGS. 1 and 2, a fuel introduction control valve 35 is mounted in the constant-pressure fuel chamber 26 for controlling the introduction of fuel from the downstream fuel passage 23*b* into the constant-pressure fuel chamber 26. The fuel introduction control valve 35 is comprised of a cylindrical valve seat member 37 mounted on the bottom plate 17 on one side of the constant-pressure fuel chamber 26, so that an inlet bore 36 in an upper end wall faces the downstream fuel passage 23*b*. A valve member 38 is vertically movably received in the valve seat member 37 to open and close the inlet bore 36, and an operating lever 40 which is swingably carried on a support shaft 39, is supported on the bottom plate 17 with one end engaged with a lower end of the valve member 38. A valve spring 41 biases the operating lever 40 in a direction to close the valve member 38, and a diaphragm 42 is mounted on a lower surface of the bottom plate 17 so as to form a bottom surface of the constant-pressure fuel chamber 26. An urging element 42*a* is mounted at a central portion of the diaphragm 42 to abut against the other end of the operating lever 40 for movement away from such other end. The diaphragm 42 has a peripheral edge fastened to the bottom plate 17 along with a cover 43 which covers the diaphragm 42. The cover 43 is provided with an air vent 44 for applying atmospheric pressure to a lower surface of the diaphragm 42.

A fuel well 45 is defined in the bottom plate 17 and is located above the other end of the constant-pressure fuel chamber 26. The fuel well 45 communicates at its lower portion with the constant-pressure fuel chamber 26 through an outlet bore 47 and at its upper portion with a lower end of the fuel nozzle 11 through a check valve 48 and a fuel jet 49.

Further, a bypass passage 50 is provided in the bottom plate 17 and passes above the constant-pressure fuel chamber 26 to permit the lower end of the valve seat member 37 to communicate with the fuel well 45.

The operation of the embodiment will be described below.

When the engine is operated, a pulsation pressure in the pulsation pressure generating source P is applied to the operating chamber 28 in the fuel pump 24 to vibrate the diaphragm 27. When the diaphragm 27 is flexed toward the operating chamber 28, the pump chamber 29 is increased in volume, thereby pumping fuel in the fuel tank T through the intake valve 30 and the upstream fuel passage 23*a*. When the diaphragm 27 is flexed toward the pump chamber 29, the pump chamber 29 is reduced in volume, thereby delivering the fuel therein toward the downstream fuel passage 23*b* through the discharge valve 32.

In this case, if the fuel in the constant-pressure fuel chamber 26 does not reach a defined amount, the diaphragm 42 is displaced upwards under the action of the atmospheric pressure to swing the operating lever 40 in a clockwise direction as viewed in FIG. 1 against the biasing force of the valve spring 41, thereby pulling down the valve member 38 to open the inlet bore 36. Therefore, the fuel in the downstream fuel passage 23*b* is introduced into the constant-pressure fuel chamber 26. When the fuel introduced into the constant-pressure fuel chamber 26 reaches the defined amount, the diaphragm 42 is lowered to pull the urging element 42*a* away from the operating lever 40. Then, the operating lever 40 pushes up the valve member 38 by the action of the biasing force of the valve spring 41, thereby closing the inlet bore 36. Thus, the introduction of the fuel into the constant-pressure fuel chamber 26 is stopped. In this manner, the defined amount of fuel is constantly stored in the constant-pressure fuel chamber 26 during operation of the engine and passes through the outlet bore 47 to fill the fuel well 45.

On the other hand, in the intake passage 2 and the throttle bore 9, a negative pressure is produced around the fuel nozzle 11. The fuel in the fuel well 45 rises sequentially in the check valve 48, the fuel jet 49 and the fuel nozzle 11 and is ejected into the throttle bore 9 by the action of the negative pressure. The ejected fuel is drawn into the engine, while being mixed with air passed through the intake passage 2 and the throttle bore 9 to produce a fuel-air mixture. The amount of fuel-air mixture into the engine is regulated by increasing or decreasing the opening degree of the throttle valve 4.

When fuel delivered from the fuel pump 24 to the downstream fuel passage 23*b* is subjected to a pressure pulsation provided by vibration of the diaphragm 42, heat or vibration from the engine, or the like to produce a fuel vapor, the fuel vapor is delivered along with the fuel from the inlet bore 36 through the valve seat member 37 to the constant-pressure fuel chamber 26, when the valve member 38 of the fuel introducing valve 35 is opened. However, because the lower end of the valve seat member 37 is in communication with the fuel well 45 through the bypass passage 50 extending above the constant-pressure fuel chamber 26, the fuel vapor which is lighter than the fuel, rises up in the bypass passage 50 to the fuel well 45 as soon as it passes through the valve seat member 37, and is then ejected promptly from the fuel nozzle 11 along with the fuel in the fuel well 45. Therefore, the amount of fuel vapor ejected from the fuel nozzle 11 is very small and varies only slightly the fuel-air ratio of the fuel-air mixture and hence, normal operation of the engine can be ensured.

Although the embodiment of the present invention has been described in detail, it will be understood that the present invention is not limited to the above-described embodiment, and various modifications in design may be made without departing from the spirit and scope of the invention defined in claims. For example, the throttle valve 4 may be constructed into a butterfly type.

What is claimed is:

1. A diaphragm carburetor comprising a constant-pressure fuel chamber having an outlet bore and an inlet bore, a fuel nozzle, a fuel jet and a check valve, said fuel chamber communicating with a lower end of said fuel nozzle through said fuel jet and check valve, a fuel passage communicating between said inlet bore in said constant-pressure fuel chamber and a fuel tank, a fuel pump communicating with said fuel passage for pumping fuel into said constant-pressure fuel chamber in response to a pulsation pressure from a pulsation pressure generating source, and a fuel introduction control valve for controlling the introduction of the fuel into said constant-pressure fuel chamber by opening and closing said inlet bore of said constant-pressure fuel chamber, said fuel introduction control valve having a cylindrical valve seat member mounted on an upper wall of said constant-pressure fuel chamber and having said inlet bore at an upper end thereof, and a valve member raised and lowered within said valve seat member for opening and closing said inlet bore, wherein a fuel well is defined between the outlet bore of said constant-pressure fuel chamber and said check valve, and the lower end of said valve seat member is in communication with said fuel well through a bypass passage extending above said constant-pressure fuel chamber.

* * * * *